US005611443A

United States Patent [19]

King

[11] Patent Number: 5,611,443

[45] Date of Patent: Mar. 18, 1997

[54] CHILD-RESISTANT CLOSURES FOR CONTAINERS

[75] Inventor: Roger M. King, Latimer, United Kingdom

[73] Assignee: Beeson and Sons Limited, Rickmansworth, United Kingdom

[21] Appl. No.: 463,215

[22] Filed: Jun. 5, 1995

[30] Foreign Application Priority Data

Feb. 24, 1995 [GB] United Kingdom ..... 9503810

[51] Int. Cl.[6] ..... B65D 50/04

[52] U.S. Cl. ..... 215/220; 215/252

[58] Field of Search ..... 215/201, 209, 215/216, 217, 220, 222, 223, 252

[56] References Cited

U.S. PATENT DOCUMENTS

| | | | |
|---|---|---|---|
| D. 207,887 | 6/1967 | Parsisson . | |
| D. 327,644 | 7/1992 | Offley et al. . | |
| D. 329,980 | 10/1992 | Powell et al. . | |
| 3,650,426 | 3/1972 | Miller | 215/220 |
| 3,770,153 | 11/1973 | Gach et al. . | |
| 3,828,519 | 8/1974 | Levey . | |
| 3,888,375 | 6/1975 | Gerk . | |
| 3,944,102 | 3/1976 | Grau . | |
| 4,093,096 | 6/1978 | Augros . | |
| 4,134,513 | 1/1979 | Mumford . | |
| 4,213,534 | 7/1980 | Montgomery . | |
| 4,280,631 | 7/1981 | Lohrman . | |
| 4,413,743 | 11/1983 | Summers . | |
| 4,480,760 | 11/1984 | Schonberger . | |
| 4,527,701 | 7/1985 | Schaubeck . | |
| 4,605,135 | 8/1986 | Ryder . | |
| 4,641,759 | 2/1987 | Kelley | 215/220 |
| 4,754,892 | 7/1988 | Retief . | |
| 4,782,965 | 11/1988 | Wassilieff | 215/220 |
| 4,957,210 | 9/1990 | Kusz . | |
| 4,997,096 | 3/1991 | Kusz . | |
| 5,020,681 | 6/1991 | Kusz . | |
| 5,103,991 | 4/1992 | Collins . | |
| 5,213,225 | 5/1993 | King et al. . | |
| 5,219,084 | 6/1993 | King . | |
| 5,411,157 | 5/1995 | King et al. . | |

FOREIGN PATENT DOCUMENTS

| | | |
|---|---|---|
| 0182519 | 5/1986 | European Pat. Off. . |
| 0443868 | 8/1991 | European Pat. Off. . |
| 724431 | 4/1932 | France . |
| 2153305 | 5/1973 | France . |
| 704508 | 4/1966 | Italy . |
| 1438885 | 6/1976 | United Kingdom . |
| 2011869 | 7/1979 | United Kingdom . |
| 1603667 | 11/1981 | United Kingdom . |
| 2114552 | 8/1983 | United Kingdom . |
| 2155447 | 9/1985 | United Kingdom . |
| 2203729 | 10/1988 | United Kingdom . |
| 2260534 | 4/1993 | United Kingdom . |
| 2261656 | 5/1993 | United Kingdom . |
| 2267484 | 12/1993 | United Kingdom . |
| WO93/01098 | 1/1993 | WIPO . |

*Primary Examiner*—Stephen P. Garbe
*Assistant Examiner*—Nathan Newhouse
*Attorney, Agent, or Firm*—Brinks Hofer Gilson & Lione

[57] ABSTRACT

A closure having an inner closure part carrying an internal screw thread for screw threaded engagement with an external screw thread on the neck of a container. The closure includes an outer closure part at least partially enclosing the inner closure part. Co-operating retaining projections are provided on the inner and outer closure parts for retaining the inner closure part within the outer closure part, and permitting limited axial movement of the inner closure part within the outer closure part. First and second sets of castellations are provided on the inner and outer closure parts, respectively. The second set of castellations interengage the first set of castellations to permit a bidirectional torque to be transmitted from the outer closure part to the inner closure part when the outer closure part is rotated in a screwing-down direction. The set of castellations on one or both of the inner and outer closure parts are chamfered or rounded such that the height of the castellations decreases from the center of the castellations to the radially outer part of the castellations, whereby accidental engagement of the sets of castellations is substantially avoided when a bending moment is applied between the inner and outer closure parts.

27 Claims, 5 Drawing Sheets

200
202
130
100
126
212
216
214
104
118
206
302
250
204
II
210
II
III
III
300

300
210
104
108
304
110
210
116

300
308

216
220

220
216
218

CHILD-RESISTANT CLOSURES FOR CONTAINERS

The present invention relates to improvements in child-resistant closure assemblies for containers, in particular child-resistant closures of the so-called "two-piece", or "push-twist" type.

Child-resistant closures of the "two-piece" or "push-twist" type are described, for example, in U.S. Pat. No. 4,527,701 and U.S. Pat. No. 5,020,681. These closures have the characteristic that they are applied to a threaded neck of a container by simply screwing them down, but in order to unscrew the closure it is necessary both to push down on the closure and at the same time to twist the closure in an unscrewing direction relative to the container. If the closure is only twisted in an unscrewing direction without pushing down, then the outside of the closure merely rotates without unscrewing from the container.

Child-resistant closures of the above type as described in the documents cited above have the following structural features:

an inner closure part carrying an internal screw thread for screw threaded engagement with an external screw thread on the neck of a container;

an outer closure part at least partially enclosing the inner closure part co-operating retaining projections on the inner and outer parts for retaining the inner part within the outer part, and for permitting limited axial movement of the inner part within the outer part;

a first set of castellations on the inner part;

a second set of castellations on the outer part arranged to inter-engage the first set of castellations on the inner part when the outer part is moved axially towards the inner part to permit full bidirectional torque to be transmitted from the outer part to the inner part when said first and second sets of castellations are engaged;

a set of resilient blades extending from a first of the inner and outer parts towards a second of the inner and outer parts, the resilient blades bearing against the said second of the inner and outer parts to urge the outer part axially in a direction away from the inner part such that the first and second sets of castellations are normally held out of inter-engagement;

each of said resilient blades having a remote end and comprising an abutment surface at the remote end; and the said second of the inner and outer parts comprising a set of ratchet projections, each of the ratchet projections comprising a stop surface and a ramp surface, the stop surface being substantially radial and being constructed and arranged to engage the abutment surface of one of the resilient blades when the outer part is rotated in a screwing-down direction to apply the closure to said neck, thereby to permit full torque to be transmitted to the inner part when the closure is being screwed down; and each of the ramp surfaces being constructed and arranged to cam one of the resilient blades over said ratchet projection when the outer closure part is rotated in an unscrewing direction so that the blades can slip relative to the ratchet projections if the outer part is rotated in the unscrewing direction without the first and second sets of castellations being in inter-engagement, the resilient blades transmitting only a limited unscrewing torque to the ratchet projections owing to frictional engagement of the resilient blades slipping over the ramp surfaces of the ratchet projections.

It follows from the above structure that rotating the outer closure part in an unscrewing direction without also depressing the closure to engage the castellations will result in the transmission of relatively little unscrewing torque to the inner closure. Provided that the minimum unscrewing torque required to unscrew the inner closure part from the neck is greater than the unscrewing torque transferred to the inner closure part by friction between the resilient blades and the ramp surfaces, the closure will not normally unscrew from the container neck unless the outer closure part is both depressed and unscrewed, so as to engage the castellations.

A drawback of the above container closure assembly is that the closure is not child proof unless it has been adequately tightened onto the container neck. If the tightening is insufficient, then the limited unscrewing torque transmitted from the outer closure part to the inner closure part by friction of the resilient blades sliding over the ramps will be enough to open the closure assembly, without any need to depress the outer closure part so as to engage the castellations. It has been found in practice that elderly or arthritic users frequently fail to apply enough closure torque to such closures to render them child proof. This is a particular problem with steeply pitched, quick-closing threads of the kind frequently used for elderly-friendly closure assemblies.

W093/01098 addresses the above drawback of conventional two-piece child-resistant closures by providing a child-resistant closure assembly comprising a closure as defined above, and further comprising:

a container neck carrying an external thread and further carrying a first locking element; and a second locking element on the inner part of the closure for engaging the first locking element on the container neck when the closure is screwed into a closed position on the neck to hold the closure in said closed position;

the first and second locking elements being constructed and arranged to resist loosening of said closure from the closed position until a predetermined release torque is applied to the inner closure part.

The predetermined release torque is selected to be greater than the frictional opening torque exerted on the inner closure part by rotation of the outer closure part in the opening direction without engagement of the castellations (mainly the frictional torque due to the resilient blades sliding over the ramps).

The arrangement of WO93/01098 greatly reduces accidental failure to re-secure the closure on the container neck in a non-child proof fashion, especially in elderly-friendly closure assemblies. This is because it is easier for the user to know when the locking elements have engaged, and also because the locking elements can be designed such that the minimum opening torque is greater than the maximum closure torque required to engage the locking elements.

It has now been found in extensive testing that another drawback of two-piece child-resistant closures as described above is that is sometimes possible for a determined child to overcome the child-proofing feature by applying a bending moment perpendicular to the axis of the closure assembly while unscrewing the outer closure part, but without depressing the outer closure part. The problem arises because the bending moment can jam the skirt of the outer closure part against the inner closure part, thereby increasing the frictional opening torque transmitted to the inner closure part. Furthermore, the rocking of the outer closure part on the inner closure part that results from applying the bending moment can cause the castellations on one side of the respective closure parts accidentally to come into engagement, even if no axial force is applied to bring them into engagement. Again, this allows the closure to be unscrewed, thereby diminishing the child-proofing performance of the closure.

Accordingly, the present invention provides a two-piece child-resistant closure comprising:

an inner closure part carrying an internal screw thread for screw threaded engagement with an external screw thread on the neck of a container;

an outer closure part at least partially enclosing the inner closure part co-operating retaining projections on the inner and outer parts for retaining the inner part within the outer part, and for permitting limited axial movement of the inner part within the outer part;

a first set of castellations on the inner part;

a second set of castellations on the outer part arranged to inter-engage the first set of castellations on the inner part when the outer part is moved axially towards the inner part to permit full bidirectional torque to be transmitted from the outer part to the inner part when said first and second sets of castellations are engaged;

a set of resilient blades extending from a first of the inner and outer parts towards a second of the inner and outer parts, the resilient blades bearing against the said second of the inner and outer parts to urge the outer part axially in a direction away from the inner part such that the first and second sets of castellations are normally held out of inter-engagement;

each of said resilient blades having a remote end and comprising an abutment surface at the remote end; and the said second of the inner and outer parts comprising a set of ratchet projections, each of the ratchet projections comprising a stop surface and a ramp surface, the stop surface being substantially radial and being constructed and arranged to engage the abutment surface of one of the resilient blades when the outer part is rotated in a screwing-down direction to apply the closure to said neck, thereby to permit full torque to be transmitted to the inner part when the closure is being screwed down;

each of the ramp surfaces being constructed and arranged to cam one of the resilient blades over said ratchet projection when the outer closure part is rotated in an unscrewing direction so that the blades can slip relative to the ratchet projections if the outer part is rotated in the unscrewing direction without the first and second sets of castellations being in inter-engagement; and further comprising means to reduce the transfer of unscrewing torque from the outer closure part to the inner closure part when a bending moment about the axis of the closure is applied between the inner and outer closure parts and the outer closure part is rotated in an unscrewing direction.

Preferably, the means to reduce the transfer of torque is provided by rounding off and/or chamfering the castellations on one or both of the inner and outer closure parts. The castellations are preferably chamfered such that the height of the castellations decreases from the centre of the castellations to the radially outer edges of the castellations. This reduces the risk that the castellations will accidentally engage on one side when the outer closure part rocks on the inner closure part.

Alternatively or additionally, the means to reduce the transfer of torque preferably comprises means to reduce rocking of the outer closure part on the inner closure part. The means to reduce rocking may comprise, for example, circumferential or longitudinal ribs or bosses on the skirt portions of the inner or outer closure parts and located between the inner and outer closure parts. More preferably, the means to reduce rocking comprises: a cylindrical socket on one of the first or second closure part, the socket being coaxial with the rotational axis of the closure; and a cylindrical projection on the other of the inner and outer parts, the cylindrical projection being coaxial with the rotational axis of the closure and being received in the cylindrical socket in a slidable mating engagement. In addition to reducing rocking of the outer closure part when a bending moment is applied to the closure, this feature also helps to ensure accurate axial alignment of the inner and outer closure parts.

This means to reduce the transfer of unscrewing torque may alternatively or additionally comprise means to increase the flexibility of the resilient blades on the inner or outer closure part. Preferably, the resilient blades are provided with a longitudinal integral reinforcing rib, giving the blades a T-shaped transverse cross-section. The longitudinal reinforcing rib allows the resilient blades to be made thinner and more flexible with relatively little loss of resilience over repeated flexure cycles. This increased durability is due to the reinforcing rib. The thinner and more flexible resilient blade exerts a smaller restoring force on the inner closure part, and thereby transmits less frictional unscrewing torque to the inner closure part when the outer closure part is rotated in an unscrewing direction without engagement of the castellations.

Alternatively or additionally, the means to reduce the transfer of torque is provided by means of a first circumferential rib on the inner surface of a skirt portion of the outer closure part and a second circumferential rib on the outer surface of a skirt portion of the inner closure part, whereby the outer closure part is retained on the inner closure part by abutment of the second circumferential rib under the first circumferential rib and there is substantially no contact between the respective skirt portions of the inner and outer closure parts other than abutment with the circumferential ribs. This arrangement reduces the abutment surface area across which frictional torque can be transmitted to the inner closure part from the outer closure part. This arrangement also helps to reduce rocking of the outer closure part on the inner closure part.

Finally, the means to reduce the transfer of torque alternatively or additionally preferably comprises means to reduce the coefficient of friction between abutting surface on the inner and outer closure parts. For example, the inner and/or outer closure parts may comprise a low-friction plastic such as PTFE. More preferably, a lubricant such as a food-approved silicone lubricant is applied to the inner and/or outer closure part in areas where there is likely to be friction between the inner and outer closure parts when the outer closure part is rotated on the inner closure part.

The present invention also provides a child-resistant container and closure assembly comprising a closure according to the present invention, and further comprising:

a container neck carrying an external thread and further carrying a first locking element; and a second locking element on the inner part of the closure for engaging the first locking element on the container neck when the closure is screwed into a closed position on the neck to hold the closure in said closed position;

the first and second locking elements being constructed and arranged to resist loosening of said closure from the closed position until a predetermined release torque is applied to the inner closure part.

Preferably, the two-piece child-resistant closure according to the present invention forms part of a container closure assembly as claimed in WO93/01098 and herein before described.

Specific embodiments of the present invention will now be described further, by way of example, with reference to the accompanying drawings, in which.

Figure 1:
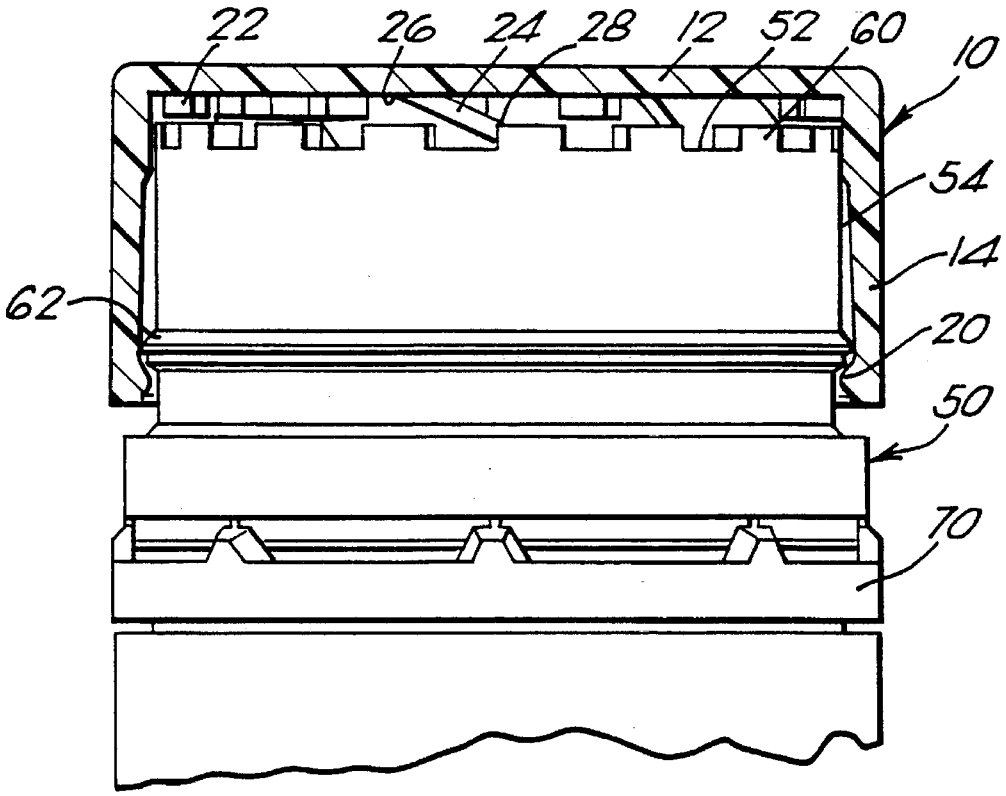
Fig. 1 (PRIOR ART)
FIG. 1 shows for comparison purposes a longitudinal cross-sectional view of a prior art two-piece child-resistant closure as claimed in W093/01098.

Referring to FIG. 1, the container closure assembly described in WO93/01098 comprises an outer closure part 10, constructed of moulded plastics (other suitable materials may be used) and consisting of a crown portion 12 and a skirt portion 14. Towards the lower, free end of the skirt portion 14, there is provided an inwardly extending bead 20, whose purpose is to retain the outer closure part on the inner closure part as will be described below.

The inner surface of the crown portion 12 is provided with sixteen equidistant castellations 22 of substantially rectangular form and four equidistant oblique resilient blades 24. The resilient blades 24 extend circumferentially from an upper, left-hand end 26, when viewed from the centre of the closure part, to a lower, right-hand free end 28.

The container closure assembly further comprises an inner closure part 50, constructed of moulded plastics (other suitable materials may be used), which includes a crown portion 52 and a skirt portion 54. The inner surface of the skirt portion 54 is provided with coarsely pitched threads (not shown) of square section and vertical ribs (not shown), which function as first locking elements to engage complementary second locking elements on the container neck. The top of the skirt portion 54 is provided with a tapered surface (not shown), which forms an interference fit seal with a complementary tapered surface on the container neck.

Depending from the lower end of the inner closure part skirt portion 54 is a tamper-evident ring 70 similar to that described below for the embodiment of the present invention.

The crown portion 52 is provided around its periphery with sixteen upstanding, substantially rectangular castellations 60. These castellations 60 are adapted to engage the complementary castellations 22 on the outer closure part 10. The outer periphery of the skirt portion 54 includes an outstanding ridge 62 below which, when the inner 50 and outer 10 closure parts are assembled, the bead 20 on the outer closure part 10 is retained. A degree of axial movement of the outer closure part 10 with respect to the inner closure part is permitted to engage and disengage the two sets of castellations 60, 22.

Sixteen equidistant ramps 64 are provided on the upper surface of the inner closure part crown portion 52. When viewed from the centre of the closure part, each ramp 64 is of substantially right triangular section having a horizontal base, a vertical left-hand side and a hypotenuse, terminating in a right-hand side.

When the outer closure part 10 is installed on the inner closure part 50, and the outer closure part 10 rotated clockwise, the free ends 28 of the resilient blades 24 abut against the vertical side of their respective ramps, thus rotating the inner closure part 50 with the outer closure part 10. However, assuming that the inner closure part 50 is reasonably tightly held in place, e.g. by a closure torque, then rotation of the outer closure part 10 anticlockwise will merely result in the resilient blades 24 camming over the ramps 64 in the manner of a ratchet mechanism.

In order for the inner closure part 50 to be rotated anticlockwise, it is necessary for the outer closure part 10 to be depressed against the action of the resilient blades 24 to allow the complementary castellations 22, 60 to engage.

The above-described container and closure assembly provides a number of advantages, as specified above and in more detail in WO93/01098. However, it has been found in the course of extensive testing that the above container and closure assembly can sometimes be opened without depressing the outer closure part to engage the castellations on the inner and outer closure parts. This can occur when a user simultaneously applies a bending moment and an unscrewing torque to the outer closure part.

Figure 2:
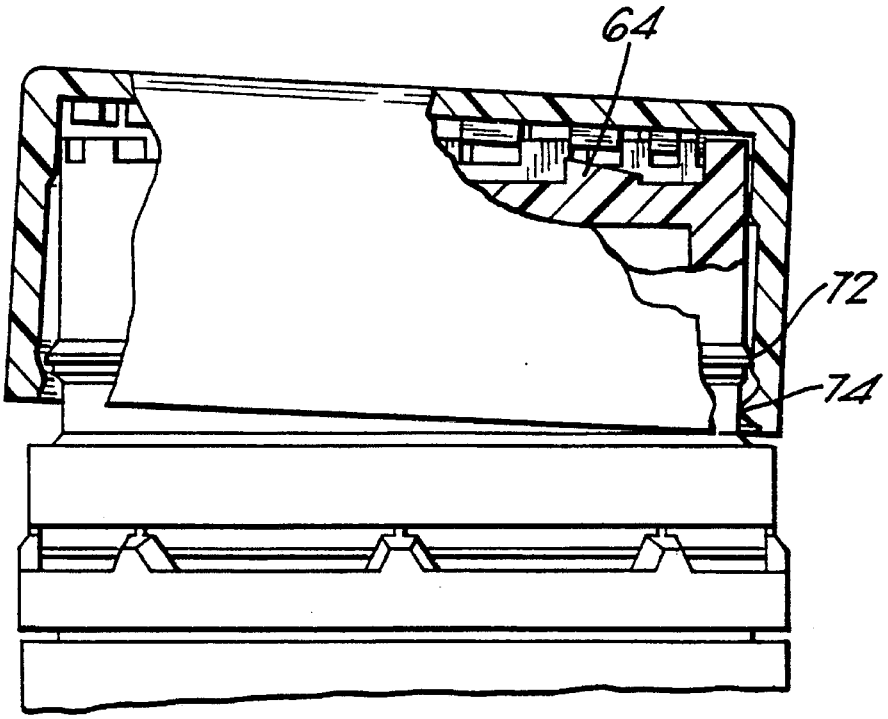
Fig. 2 (PRIOR ART)
FIG. 2 shows a longitudinal cross-sectional view of the prior art closure of FIG. 1 to which a bending moment has been applied.
Figure 3:
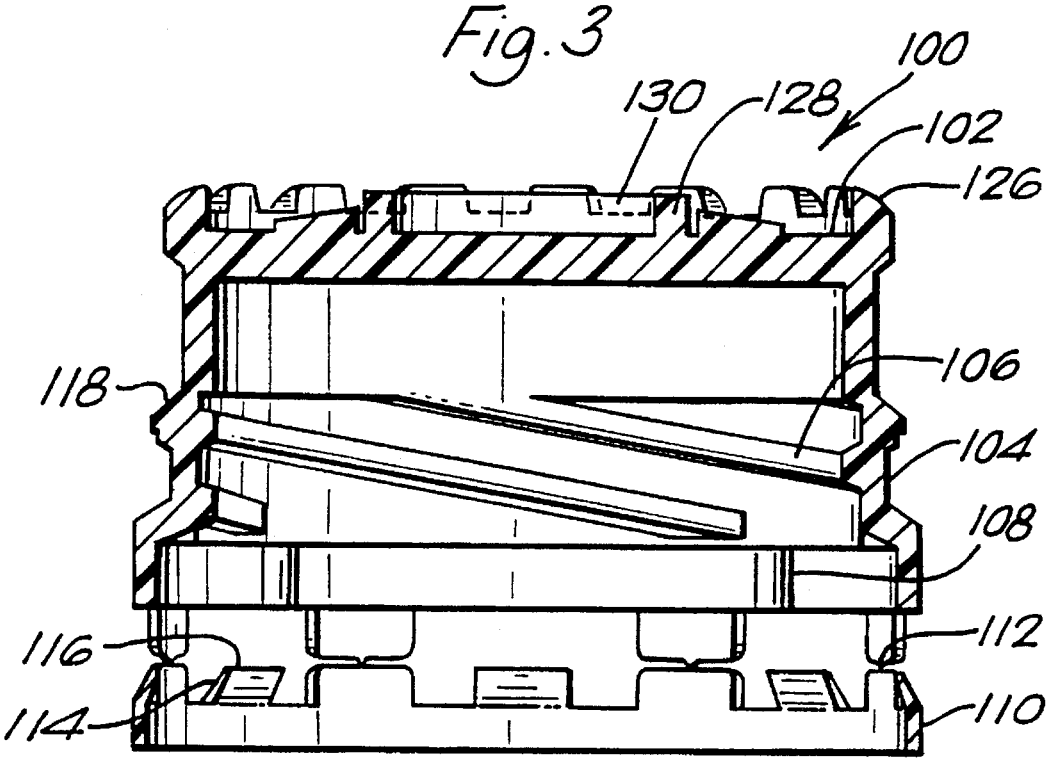
FIG. 3 shows a transverse longitudinal cross-section through the inner part of a closure according to the present invention.
Figure 4:
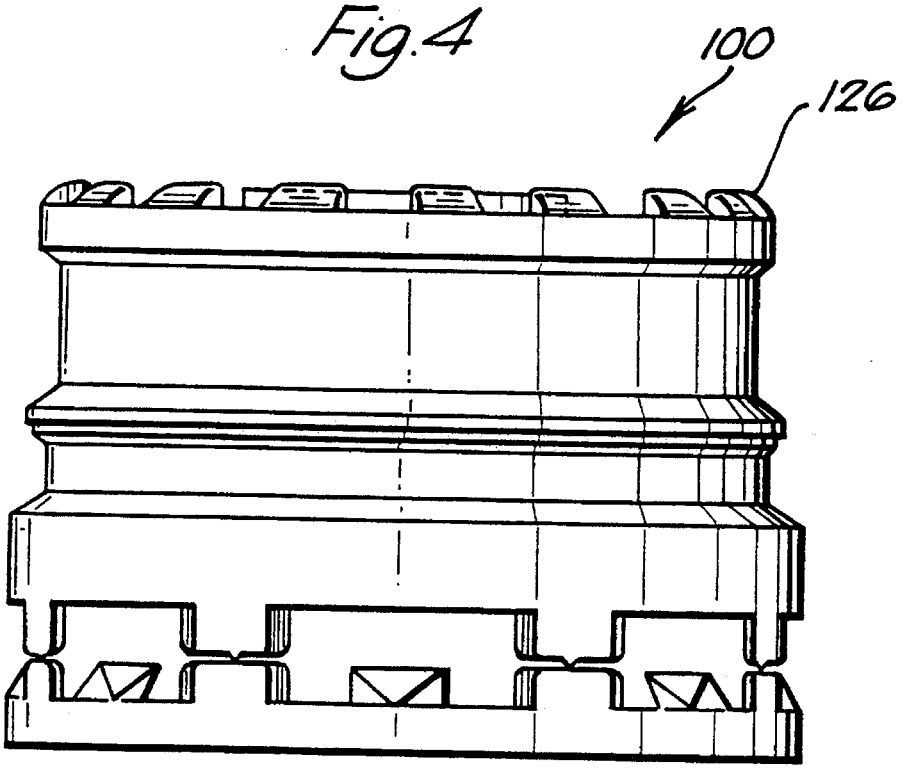
FIG. 4 shows a side elevation view of the inner part shown in FIG. 3.

FIG. 2 illustrates how the application of bending moment can sometimes overcome the child-resistance of the above-described container and closure assembly. The bending moment rocks the outer closure part 10 on the inner part 50, resulting in increased friction between the skirt portions 14, 54 of the inner and outer parts as the skirt portions are jammed together in regions 72, 74 on one side of the skirts. The rocking of the outer closure part may also cause the castellations 22, 60 on the inner and outer closure parts accidentally to come into engagement on one side as shown in FIG. 2, even though no axial downward force has been applied to the outer closure part 10. The effect of increased friction and/or accidental engagement of the castellations is to increase the transfer of unscrewing torque from the outer closure part to the inner closure part 50, in some cases sufficiently to result in accidental unscrewing of the closure.

Referring to FIGS. 3–11, the embodiment of the present invention mitigates the above-identified disadvantage of existing child-resistant closures by means of a number of closely related novel features.

The container closure according to the present invention comprises an inner part 100 and an outer part 200. The inner part 100 is shown in detail in FIGS. 3–6. The inner part 100 comprises a crown portion 102 and a skirt portion 104. The inner part is preferably formed by injection molding of a thermoplastic such as polypropylene. The skirt portion 104 is provided with internal threads 106 for engaging with complementary threads on the neck of a container. The internal threads 106 are of the 4-start, ¼-turn type for easy opening and closing of the closure by the elderly or arthritic. The internal threads 106 are of the free-running, or parallel, type in order further to simplify engagement of the internal threads 106 on the container neck by providing a constant, very low closure torque until the locking elements (see below) are engaged. The internal threads 106 may be of any cross-section, but are preferably of square or trapezoidal cross-section (the trapezoidal cross-section shown in FIG. 3 makes the inner closure part easier to "bump off" an injection mold mandrel).

Located below the threads 106 on the interior of the skirt portion 104 of the inner closure part 100 are four radially equidistant longitudinal ribs 108. These ribs are a first locking element for engaging with a complementary second locking element, such as a recess, on the neck of the container when the closure is screwed down onto the container. The inclusion of such locking elements provides a number of advantages, including the following: (1) the locking elements can be designed to provide a minimum opening torque that exceeds the maximum closure torque needed to secure the closure in childproof fashion, and that also exceeds the frictional torque in an unscrewing direction transmitted to the inner closure part by rotation of the outer closure part without engagement of the castellations, thereby reducing the risk of accidental unscrewing of the closure; (2) the locking elements remove the risk that the closure will back off from the closed position (this feature is especially important when steeply pitched and/or free-running parallel threads are used); (3) the locking elements engage with an audible and/or sensible "click" that indicates to the user the moment when the closure has been secured on the container neck in a childproof fashion; (4) the locking elements engage at a defined angular position of the closure on the container neck, which also reduces the risk that the closure will be under-tightened on the neck; and (5) the locking elements on the neck may be associated with abutment means to abut against the locking elements on the neck and thereby prevent over-tightening of the closure on the container neck.

Below the longitudinal rib locking elements 108 on the inner closure part 100 there is provided a tamper-evident ring 110 of the kind described and claimed in PCT/GB93102341. Briefly, the tamper-evident ring 110 is integral with the rest of the inner closure part 100 and is attached thereto by tangible bridges 112. Spaced around the tamper-evident ring 110 are a plurality of inwardly projecting ring retaining clips 114 having upwardly projecting leading edges 116 for abutting the underside of a circumferential retaining lip on the container. The ring retaining clips 114 are radially flexible, which allows the tamper-evident ring 110 to be snap-fitted over the retaining lip on the container when the inner closure part 100 is first secured to the neck of the container. When the inner closure part 100 is then first unscrewed from the container neck, the abutment of the leading edges 116 against the underside of the circumferential lip causes the tamper-evident ring 110 to separate from the rest of the inner closure part 100 at the frangible bridges.

The outer surface of the skirt portion 104 of the inner closure part 100 is provided with a circumferential rib 118 for retaining the outer closure portion 200 on the inner closure portion 100.

Figure 5:
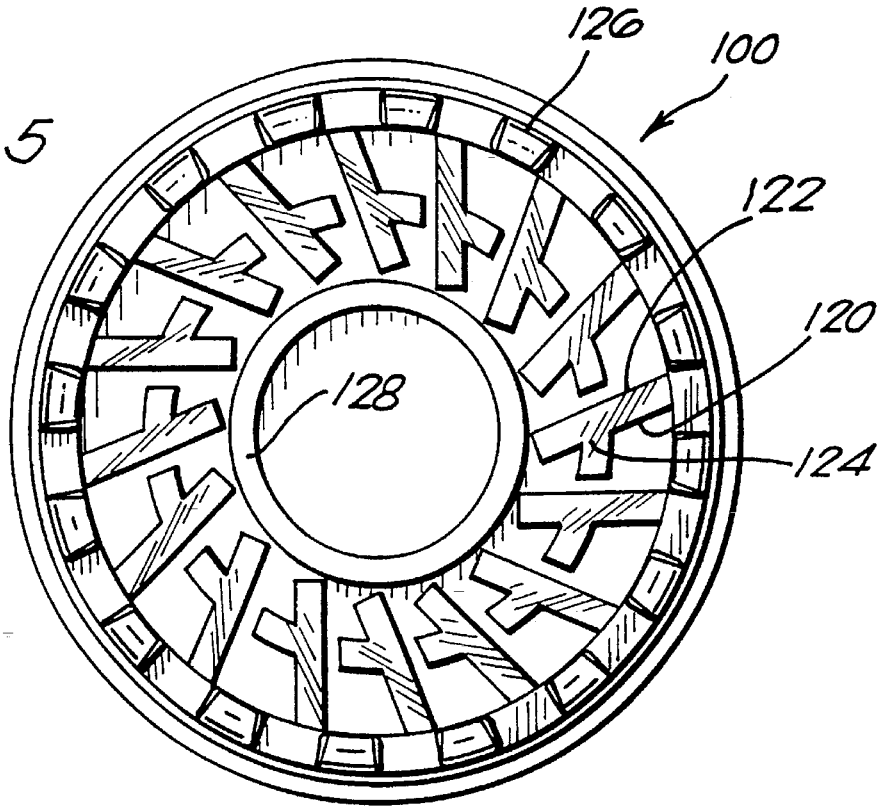
FIG. 5 shows a top plan view of the inner part shown in FIGS. 3 and 4.
Figure 6:
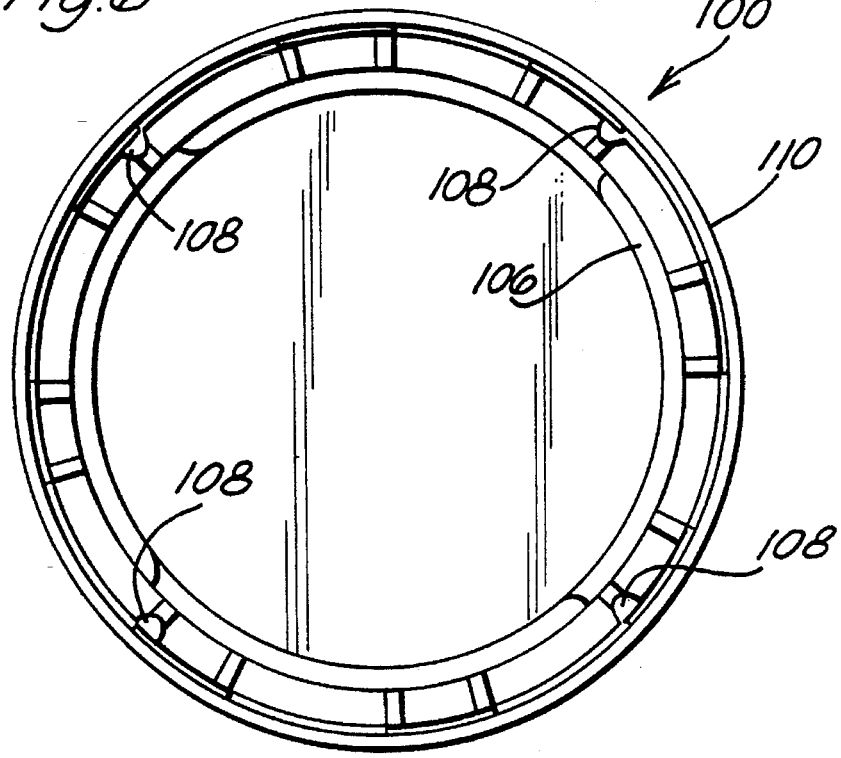
FIG. 6 shows a bottom plan view of the inner part shown in FIGS. 3, 4 and 5.

Referring to FIG. 5, the crown portion 102 of the inner part 100 of the closure according to the present invention is provided with a plurality of radially equidistant ramps 120 on its upper surface. The number, structure and function of these ramps 120 are substantially identical to those of the ramps 64 on the assembly of WO93/01098 discussed above. Briefly, when viewed from the centre of the inner closure part 100, each ramp 120 is of substantially right triangular section having a horizontal base, a vertical left-hand side 122 for abutting against a leading edge of a resilient blade on the outer closure part when the closure is being screwed down, and a hypotenuse forming a ramp surface 124 over which the resilient blades on the outer closure part cam when the outer closure part 200 is rotated in an unscrewing direction relative to the inner closure part 100.

The top surface of the crown portion 102 of the inner closure part 100 is further provided with sixteen radially equidistant castellations 126. It is one important aspect of the present invention that the castellations 126 are chamfered such that the height of the castellations decreases with increasing radial distance from the axis of the inner closure part 100. This contrasts with the castellations on existing child-resistant closures of this type, which have square-edged castellations only.

The top surface of the crown portion 102 of the inner closure part 100 is further provided with an annular upwardly projecting rib 128, which defines a cylindrical socket 130 coaxial with the rotational axis of the inner closure part 100.

Figure 7:
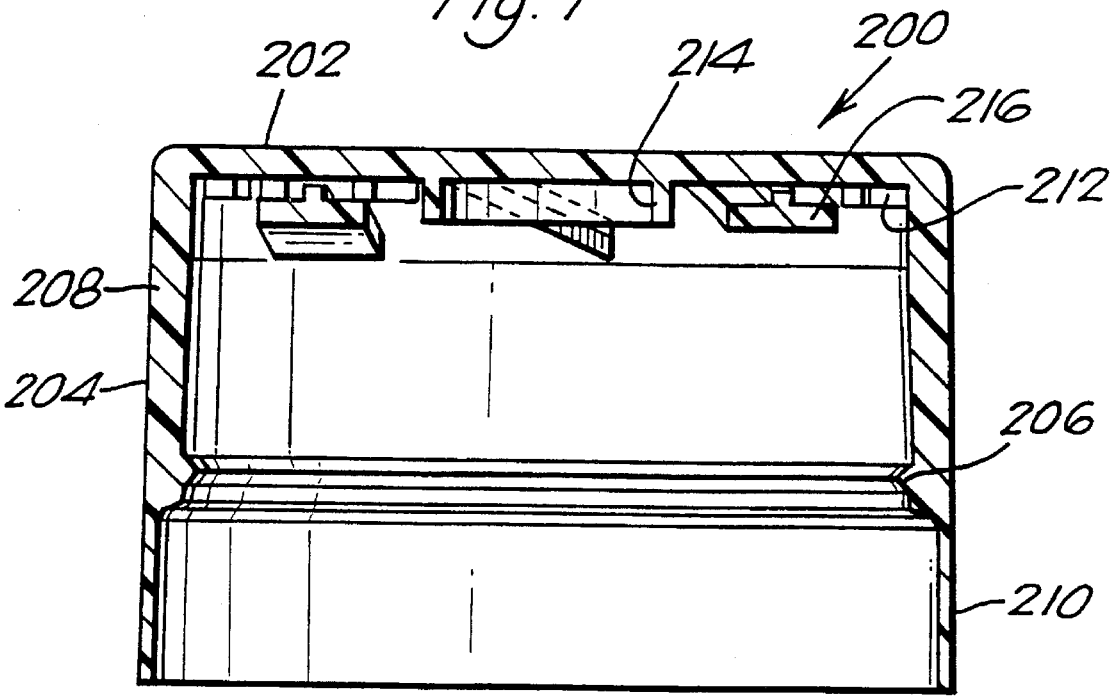
FIG. 7 shows a transverse longitudinal cross-section through the outer part of a closure according to the present invention.
Figure 8:
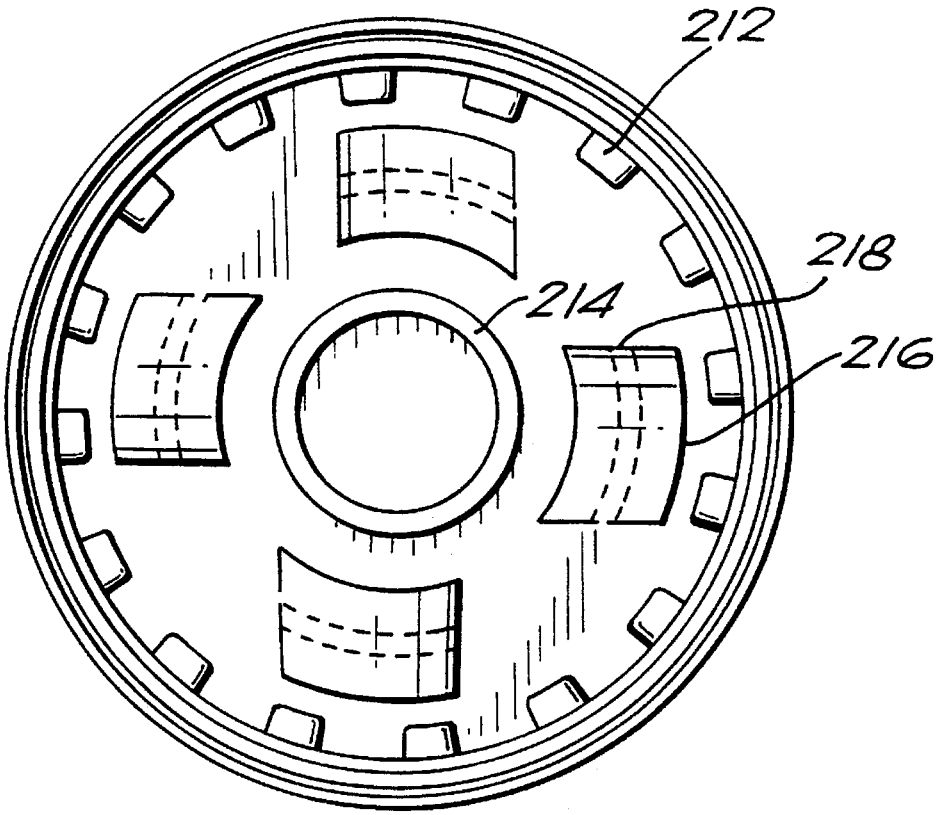
FIG. 8 shows a bottom plan view of the outer part shown in FIG. 7.

Referring now to FIGS. 7 and 8, the outer closure part 200 comprises a crown portion 202 and a skirt portion 204. The outer closure part is preferably formed by injection molding of a thermoplastic material such as polypropylene. The outer surface of the skirt portion 204 is knurled to assist gripping and rotating of the closure. The inner surface of the skirt portion 204 is provided with a circumferential inwardly projecting rib 206 for retaining the outer closure part 200 on the inner closure part.

The skirt portion 204 of the outer closure part 200 comprises an upper skirt 208 of relatively thick cross-section and a lower skirt 210 of relatively thin cross-section below the inwardly projecting rib 206, whereby the internal bore of the skirt portion 204 is substantially larger below the inwardly projecting rib 206 than above the inwardly projecting rib (206). The reason for this will be discussed further below.

The crown portion 202 of the outer closure part 200 is provided on its lower surface with sixteen castellations 212 for engaging the castellations 126 on the inner closure part 100 when the outer closure part is depressed. In this particular embodiment, the outer closure part castellations 212 are of rectangular cross-section, but it will be appreciated that in alternative embodiments the outer closure castellations may be chamfered in similar fashion to the inner closure castellations 126 of this embodiment.

The crown portion 202 of the outer closure part 200 is further provided on its lower surface with a depending annular rib 214 defining a cylinder concentric with the axis of rotation of the outer closure part 200 and dimensioned to be received in slidable mating engagement in the cylindrical socket 130 on the top surface of the crown portion 102 of the inner closure part 100.

Figures 9, 10, 11, 12, 13:
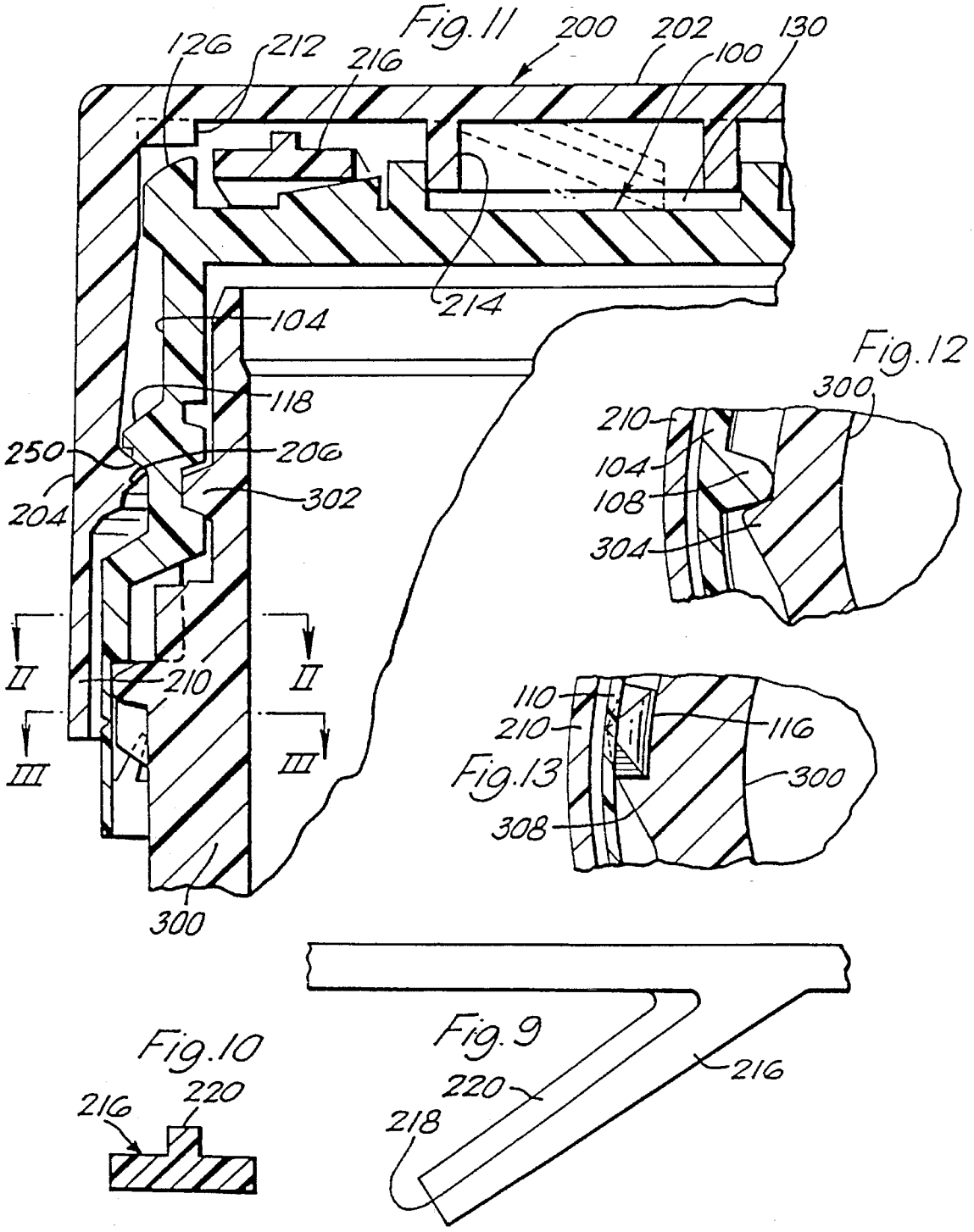
FIG. 9 shows a detailed side elevation view of one of the resilient blades on the outer part of FIGS. 7 and 8.
FIG. 10 shows a transverse cross section along I—I through the resilient blade of FIG. 9.
FIG. 11 shows a partial longitudinal cross-section view of a container and closure assembly according to the present invention, in which the closure according to the present invention is secured in a child-proof fashion to the threaded neck of a container.
FIG. 12 shows a partial transverse cross-section through the assembly of FIG. 11 along II—II.
FIG. 13 shows a partial transverse cross-section through the assembly of FIG. 11 along III—III.

The crown portion 202 of the outer closure part 200 is further provided on its lower surface with four resilient blades 216, each having a leading edge 218 for abutting against the ramps 120 on the inner closure part 100, as described further below. The detailed shape of the resilient blades is shown in FIGS. 9 and 10. The resilient blades 216 are formed generally as leaf springs. The resilient blade 216 is thicker at its base, becoming progressively thinner towards its free edge 218. The joint of the resilient blade 216 with the outer closure part 200 is radiused. Finally, an integral reinforcing rib 220 extends down the back of the resilient blade 216. That is to say, the resilient blade 216 has a T-shaped transverse cross-section as shown in FIG. 10. It has been found that this structure for the resilient blade allows the resilient blade to be made highly flexible whilst still retaining acceptable resilience over a large number of compression and release cycles. The highly flexible resilient blade exerts a smaller restoring force when it is flexed, and hence exerts less frictional unscrewing torque on the inner closure part 100 when the resilient blade is cammed over the ramps 120 by rotation of the outer closure part 200 in an unscrewing direction without engagement of the castellations 126, 212. The smaller restoring force exerted by the resilient blades 216 also makes the closure easier to open by elderly or arthritic users, who are only able to exert a relatively feeble downward force on the outer closure part to engage the castellations 126, 212 when unscrewing the closure. Hitherto, it has not been possible to provide closures of this type with highly flexible resilient blades 126, because resilient blades of the requisite thinness tend to lose resilience after a number of compression and release cycles. Moreover, the thin resilient blades could be bent permanently out of shape by excessive closing torque applied when screwing down the closure. The T-shape cross-section of the resilient blades 216 greatly reduces these problems.

Referring to FIG. 11, the closure according to the present invention is assembled by snap fitting the outer closure part 200 over the inner closure part 100. The outer closure part 200 is retained on the inner closure part 100 by the abutment between the circumferential ribs 118, 206 on the skirt portions 104, 204 of the inner and outer closure parts. The resilient blades 216 keep the outer closure portion 200 axially upwardly displaced so that the castellations 126, 212 on the inner and outer closure parts do not come into engagement unless an axial downward force is applied to the outer closure part 200 to overcome the resilience of the blades 216. It should be noted that the inner and outer closure parts 100, 200 only abut in the region of the circumferential ribs 118, 206 and where the leading edges of the resilient blades 216 contact the top of the inner closure part. In particular, the relatively large internal bore of the lower skirt 210 of the outer closure part 200 ensures that there is no abutment between the lower skirt 210 and the skirt 104 of the inner closure part 100. The small total abutment area between the inner and outer closure portions reduces the frictional unscrewing torque that is transmitted to the inner closure part when the outer closure part is rotated in the unscrewing direction without engagement of the castellations 126, 212. This reduces the risk of accidental unscrewing of the closure. The friction between the inner and outer closure parts 100, 200 is further reduced by applying a layer of a food-approved silicone lubricant 250 to at least the regions where the inner and outer closure parts abut.

FIG. 11 also shows the annular depending rib 214 on the underside of the crown portion 202 of the outer closure part 200 received in a slidable mating engagement in the cylindrical socket 130 defined on the top surface of the inner part 100. This engagement helps to keep the outer closure part 200 accurately centered on the inner closure part 100, and helps to reduce rocking of the outer closure part 200 when a bending moment is applied to the outer closure part 200.

Referring again to FIGS. 11 to 13, the container and closure assembly according to the invention further comprises a container neck 300 provided with an external thread 302 complementary to the internal thread 106 on the skirt portion 104 of the inner closure part 100. The container neck 300 is further provided with locking elements 304 below the external thread. The locking elements 304 engage the longitudinal ribs 108 on the inner part 100 of the closure when the closure is in its closed positioned on the container neck 300. The engagement between the locking elements 304 and the ribs 108 resists unscrewing of the closure until a predetermined, minimum opening torque is applied to the inner closure part 100.

Below the locking elements 304 on the container neck 300 is provided a circumferential retaining lip 306, against the underside of which abut the upwardly projecting leading edges 116 of the flexible retaining clips 115 on the tamper evident ring 110 on the inner closure part 100. The container neck 300 is also provided with ratchet projections 308 as described in PCT/GB93/02341. The ratchet projections 308 obstruct rotation of the tamper-evident ring in the unscrewing direction, and hence help to ensure that the tamper-evident ring 110 is sheared from the rest of the inner closure part 100 when the closure is first unscrewed from the container neck 300.

The above embodiments have been described by way of example only. Many other embodiments falling within the scope of the accompanying claims will be apparent to the skilled reader.

I claim:

1. A closure for threaded engagement in child-proof fashion on a threaded neck of a container, said closure comprising:

an inner closure part carrying an internal screw thread for screw threaded engagement with an external screw thread on the neck of a container;

an outer closure part at least partially enclosing the inner closure part;

co-operating retaining projections on the inner and outer closure parts for retaining the inner closure part within the outer closure part, and for permitting limited axial movement of the inner closure part within the outer closure part;

a first set of castellations on the inner closure part;

a second set of castellations on the outer closure part arranged to inter-engage the first set of castellations on the inner closure part when the outer closure part is moved axially towards the inner closure part to permit full bidirectional torque to be transmitted from the outer closure part to the inner closure part when said first and second sets of castellations are engaged;

a set of resilient blades extending from a first of the inner and outer closure parts towards a second of the inner and outer closure parts, the set of resilient blades bearing against the said second of the inner and outer closure parts to urge the outer closure part axially in a direction away from the inner closure part such that the first and second sets of castellations are normally held out of interengagement;

each one of said set of resilient blades having a remote end and comprising an abutment surface at the remote end;

said second of the inner and outer closure parts comprising a set of ratchet projections, each one of the set of ratchet projections comprising a stop surface and a ramp surface, the stop surface being substantially radial and being constructed and arranged to engage the abutment surface of one of the resilient blades when the outer closure part is rotated in a screwing-down direction to apply the closure to said neck, thereby to permit full torque to be transmitted to the inner closure part when the closure is being screwed down;

each of the ramp surfaces of said set of ratchet projections being constructed and arranged to cam one of the set of resilient blades over said set of ratchet projection when the outer closure part is rotated in an unscrewing direction so that the resilient blades can slip relative to the set of ratchet projections if the outer closure part is rotated in the unscrewing direction without the first and second sets of castellations being in inter-engagement; and wherein the set of castellations on one or both of the inner and outer closure parts are chamfered or rounded such that the height of the castellations decreases from the center of the castellations to the radially outer edges of the castellations, whereby accidental engagement of the first and second sets of castellations is substantially avoided when a bending moment is applied between the inner and outer closure parts.

2. A closure according to claim 1 further comprising means to reduce rocking of the outer closure part on the inner closure part.

3. A closure according to claim 2, wherein the means to reduce rocking comprises one or more circumferential ribs on the outside of a skirt portion of the inner closure part.

4. A closure according to claim 2, wherein the means to reduce rocking comprises one or more circumferential ribs on the inside of a skirt portion of the outer closure part.

5. A closure according to claim 4, wherein the means to reduce rocking comprises one or more circumferential ribs on the outside of a skirt portion of the inner closure part.

6. A closure according to claim 5, wherein the means to reduce rocking comprises:

a cylindrical socket on a crown portion of one of the first or second closure parts, the cylindrical socket being coaxial with the rotational axis of the closure; and a cylindrical projection on a crown portion of the other of the first or second closure parts, the cylindrical projection being received in the cylindrical socket in a slidable mating engagement.

7. A closure according to claim 4, wherein the means to reduce rocking comprises:

a cylindrical socket on a crown portion of one of the first or second closure parts, the cylindrical socket being coaxial with the rotational axis of the closure; and a cylindrical projection on a crown portion of the other of the first or second closure parts, the cylindrical projection being received in the cylindrical socket in a slidable mating engagement.

8. A closure according to claim 2, wherein the means to reduce rocking comprises:

a cylindrical socket on a crown portion of one of the first or second closure parts, the cylindrical socket being coaxial with the rotational axis of the closure; and a cylindrical projection on a crown portion of the other of the first or second closure parts, the cylindrical projection being received in the cylindrical socket in a slidable mating engagement.

9. A closure according to claim 2, wherein the means to reduce rocking comprises one or more longitudinal reinforcing ribs on the resilient blades.

10. A closure according to claim 1 wherein the thickness of a skirt portion of the outer closure part is nonuniform, whereby an area of an abutment surface between respective skirt portions of the inner and outer closure parts, is minimized.

11. A closure according to claim 2 wherein the thickness of a skirt portion of the outer closure part is nonuniform, whereby an area of an abutment surface between respective skirt portions of the inner and outer closure parts, is minimized.

12. A closure according to claim 1, further comprising means to reduce the coefficient of friction between abutting surfaces on the inner and outer closure parts.

13. A closure according to claim 12, wherein the means to reduce the coefficient of friction comprises a lubricant applied to the abutting surfaces of the inner and outer closure parts.

14. A closure according to claim 2, further comprising means to reduce the coefficient of friction between abutting surfaces on the inner and outer closure parts.

15. A closure according to claim 14, wherein the means to reduce the coefficient of friction comprises a lubricant applied to the abutting surfaces of the inner and outer closure parts.

16. A container and closure assembly comprising a closure according to claim 1, and further comprising:

a container neck carrying an external thread and further carrying a first locking element; and a second locking element on the inner closure part of the closure for engaging the first locking element on the container neck when the closure is screwed into a closed position on the neck to hold the closure in said closed position;

the first and second locking elements being constructed and arranged to resist loosening of said closure from the closed position until a predetermined release torque is applied to the inner closure part.

17. A container and closure assembly according to claim 16, wherein the second locking element comprises a longitudinal rib on the inside of a skirt portion of the inner closure part of the closure.

18. A container and closure assembly according to claim 17, wherein the closure is movable between a fully closed position and a fully disengaged position with respect to said neck by rotation through about 180° or less.

19. A container and closure assembly according to claim 18, wherein the closure is movable between a fully closed position and a fully disengaged position with respect to said neck by rotation through about 90° or less.

20. A container and closure assembly according to claim 16, wherein the closure is movable between a fully closed position and a fully disengaged position with respect to said neck by rotation through about 180° or less.

21. A container and closure assembly according to claim 20, wherein the closure is movable between a fully closed position and a fully disengaged position with respect to said neck by rotation through about 90° or less.

22. A container and closure assembly comprising a closure according to claim 2, and further comprising:

a container neck carrying an external thread and further carrying a first locking element; and a second locking element on the inner closure part of the closure for engaging the first locking element on the container neck when the closure is screwed into a closed position on the neck to hold the closure in said closed position;

the first and second locking elements being constructed and arranged to resist loosening of said closure from the closed position until a predetermined release torque is applied to the inner closure part.

23. A container and closure assembly according to claim 22, wherein the second locking element comprises a longitudinal rib on the inside of a skirt portion of the inner closure part of the closure.

24. A container and closure assembly according to claim 23, wherein the closure is movable between a fully closed position and a fully disengaged position with respect to said neck by rotation through about 180° or less.

25. A container and closure assembly according to claim 24, wherein the closure is movable between a fully closed position and a fully disengaged position with respect to said neck by rotation through about 90° or less.

26. A container and closure assembly according to claim 22, wherein the closure is movable between a fully closed position and a fully disengaged position with respect to said neck by rotation through about 180° or less.

27. A container and closure assembly according to claim 26, wherein the closure is movable between a fully closed position and a fully disengaged position with respect to said neck by rotation through about 90° or less.

* * * * *